United States Patent [19]

Parker et al.

[11] Patent Number: 4,467,597

[45] Date of Patent: Aug. 28, 1984

[54] METHOD OF SPINNING A YARN FROM TWO TYPES OF STABLE FIBERS

[75] Inventors: Alan Parker, Bolton; William M. Farnhill, Burnley, both of England

[73] Assignee: Platt Saco Lowell Corporation, Greenville, S.C.

[21] Appl. No.: 399,099

[22] Filed: Jul. 16, 1982

Related U.S. Application Data

[63] Continuation-in-part of Ser. No. 324,465, Nov. 24, 1981, Pat. No. 4,399,650, which is a continuation-in-part of Ser. No. 88,262, Oct. 25, 1979, Pat. No. 4,315,398.

[30] Foreign Application Priority Data

Jul. 25, 1981 [GB] United Kingdom ..... 8123030

[51] Int. Cl.[3] ..... D01H 7/892; D01H 1/12

[52] U.S. Cl. ..... 57/401; 57/408; 57/409

[58] Field of Search ..... 57/400, 401, 408, 409, 57/413

[56] References Cited

U.S. PATENT DOCUMENTS

| | | | |
|---|---|---|---|
| 3,913,310 | 10/1975 | Fehrer | 57/401 |
| 4,202,163 | 5/1980 | Turk et al. | 57/412 X |
| 4,249,368 | 2/1981 | Ferhrer | 57/401 X |
| 4,348,859 | 9/1982 | Olsson | 57/401 |

*Primary Examiner*—Donald Watkins
*Attorney, Agent, or Firm*—Donald H. Feldman

[57] ABSTRACT

A method of open-end spinning a yarn formed of two different types of fibers of staple fiber and a yarn formed thereby in which most of the outer fibers are formed of one type of fiber and most of the inner fibers are formed of the other component. The types of fibers are integrally linked by orienting and distributing the fibers as they approach the open end such that they lie substantially parallel to the open end and overlapping whereby part of some of the fibers of the inner type of fiber wrap around some of the fibers of the outer type of fiber.

8 Claims, 5 Drawing Figures

METHOD OF SPINNING A YARN FROM TWO TYPES OF STABLE FIBERS

CROSS-REFERENCE TO RELATED APPLICATIONS

This application is a continuation-in-part of copending U.S. application Ser. No. 324,465 filed on Nov. 24th 1981, now U.S. Pat. No. 4,399,650, by the same coinventors and entitled "A friction type yarn spinner", which application is a continuation-in-part of U.S. application Ser. No. 88,262, filed Oct. 25, 1979, now U.S. Pat. No. 4,315,398 under the title "Open-End Spinning apparatus".

BACKGROUND OF THE INVENTION

This invention relates to a method of spinning yarn from two different types of staple fibers.

Previously this has been carried out using open-end spinning techniques, either by intimately blending the two types of fibers prior to yarn formation to form a yarn where the fibers of the different types are as far as possible distributed in a completely random fashion across the cross-section of the blend or by keeping the fiber types separate. This latter can be done using an open-end technique to form a so-called core-sheath yarn, where the core component is formed of one fiber type and a sheath component wrapped around the core, is formed by the other fiber type. Alternatively, on a ring frame two types of staple fibers can be fed to form a mock-grandrelle yarn, wherein the fibers of the two types, forming distinct components, wrap around each other in a manner similarly to the forming of a two fold yarn.

The present integral structure has the advantage unique that its properties of extension, strength and heat shrinkage are integrated and its different types of fibers are combined intimately in such a way so that the yarn resultant exhibits substantially uniform properties of a single, strand, just as though the strand had been formed with a single fiber type of staple fiber.

In the core-sheath structure of yarns of the prior art the properties of the two components sheath and core, each formed from a different fiber type remain separate and distinct from one another whereby, for example, the strength and heat-shrinkage of the yarn is adversely affected in what is known as two stage break, and also exhibits a nonuniform or differential shrinkage across the strand's cross-section. The past known core-sheath structure, however, has the major advantage that substantially all of the outside or sheath fibers are of one fiber type.

One example of the core-sheath method of yarn formation is disclosed in U.S. Pat. No. 4,130,983 (Barmag) which describes in column 2 a process in which, in a friction spinning apparatus, fibers of one fiber type form a core component and fibers of a second fiber type then are fed at a position axially displaced from that of the feed of the first type fiber to wrap around the core and form a sheath.

OBJECT OF THE INVENTION

It is an object of the present invention to provide a method of yarn formation from two different types of fibers which places fibers of one type mainly on the outside of the yarn, while providing linking between the core component and sheath component such that the yarn resultant exhibits integrated properties of strength, extension and heat shrinkage.

SUMMARY OF THE INVENTION

Accordingly, the method comprises feeding discrete fibers of two different fiber types to form a strand with one end open in such a manner that the fibers of one type join the strand thereat and the fibers of the other type join the strand as it is being formed at a position axially spaced from the open-end, twisting the strand to form an integral yarn of the invention and withdrawing the yarn, wherein:

(a) an orienting of the fibers is pursued such that as they approach the site or zone of yarn strand formation they are ranged in a continuum of fiber types from one type of fibers to an admixture of both types of fibers and then to the other type of fibers, and wherein; at least some of them lie axially oriented substantially parallel to the axis of the strand, being formed and (b) a continuous and concurrent depositing and twisting of fibers is pursued as said continuum of types of fibers, which continuum upon deposition extends from the one or open-end of the zone of yarn formation to the other end of the zone, whereat the formed composite yarn is withdrawn.

In addition, the invention provides a yarn formed from first and second different types of staple fibers wherein the fibers of the first type lie mainly on the inside of the composite yarn strand and the fibers of the second type lie mainly to the outside of the composite strand, and at least part of some of the fibers of the first type normally forming the core component wrap about at least part of some of the fibers of the second type.

PREFERRED EMBODIMENT OF THE INVENTION

The invention will now be more particularly described in conjunction with the disclosure in U.S. Pat. No. 4,315,398 and the appended drawings to which mention is made. This patent, discloses in detail a friction spinning apparatus and its mode of use and reference should be made to its content for a fuller understanding of the following descriptions.

Figure 1:
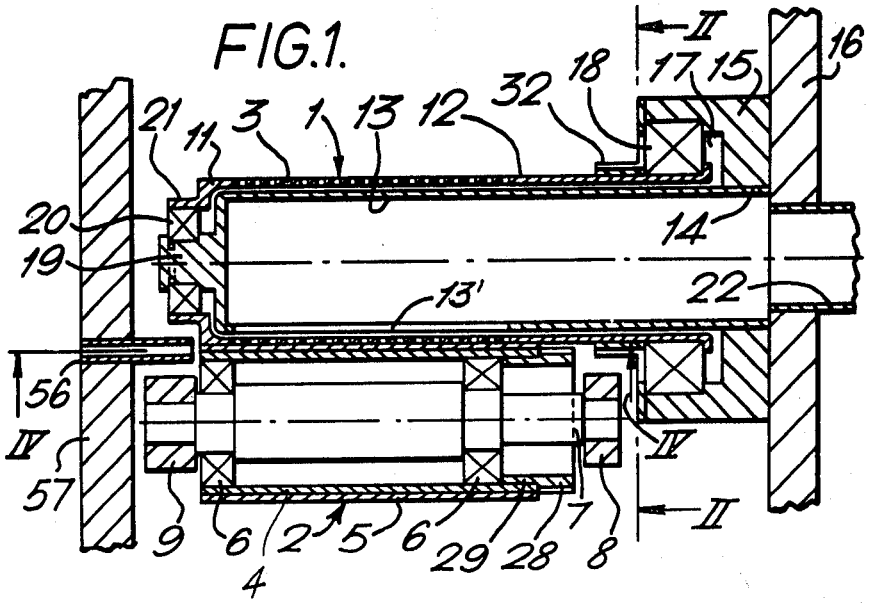
FIG. 1 is a plan view of the apparatus which may be used to pursue the present process, shown partially in section as view along line I—I of FIG. 2.
Figure 5:
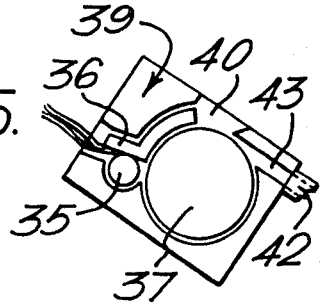
FIG. 5 in plan view shows the opening roller construction of the fiber feed means of the apparatus without a showing of sliver guides and trumpets of conventional form.
Figure 4:
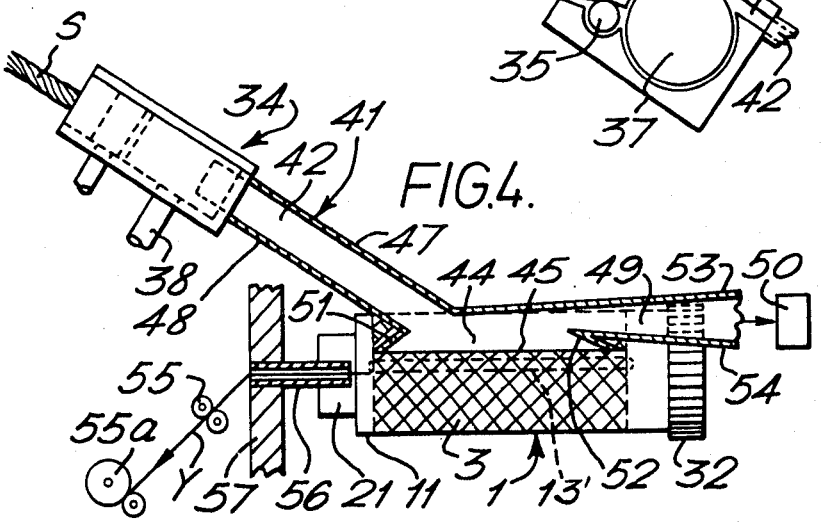
FIG. 4 shows the apparatus in section, viewed along line IV—IV of FIG. 1.
Figure 2:
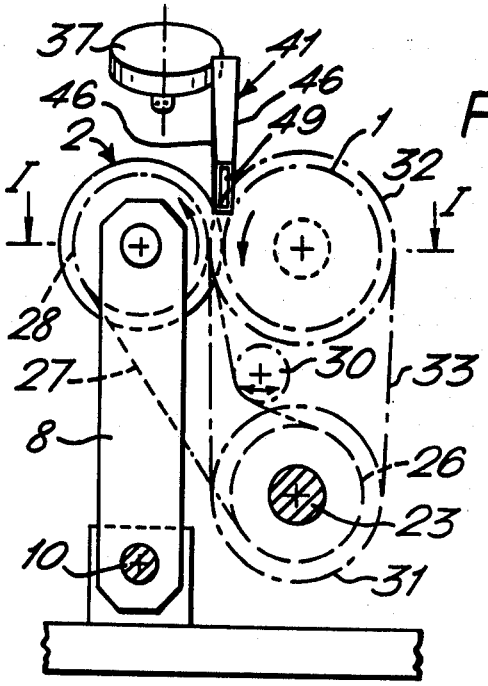
FIG. 2 is a sectional view of the aforesaid apparatus when viewed along line II—II of FIGS. 1 and 3.
Figure 3:
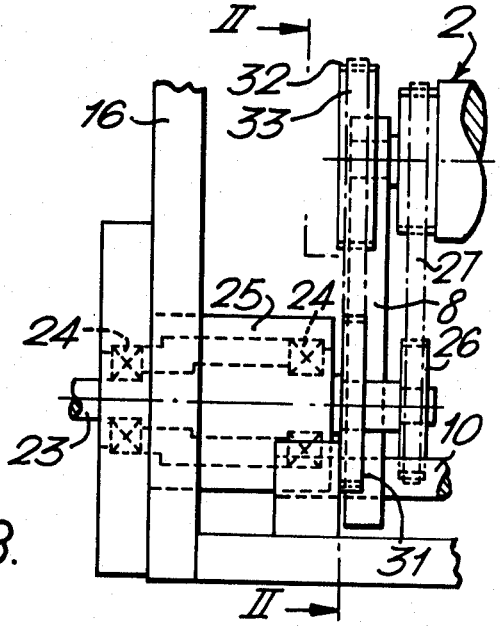
FIG. 3 is a partial side elevational view of the present apparatus showing the drive arrangements for rollers 1 and 2, with roller 1 removed for greater clarity of understanding.

The present invention requires that the apparatus described particularly in FIGS. 4 and 5 be slightly modified, only in that sliver guides or trumpets (not shown) of conventional form are added to the fiber feed means 34 at its entrance so that two separate slivers can be guided onto the feed roller 35 in a side by side relationship. The guides are arranged such that the slivers as they are drawn onto the feed roller 35 lie closely adjacent to one another but only with a small if any overlap. Thus the slivers are attacked by substantially axially separate but adjacent parts of the beater 37 (FIGS. 2 and 5).

As described in the above mentioned patent, the fibers carried by the beater 37 are ejected into the single feed duct 41 and are oriented by the feed duct and the airstreams in it such that as they approach the throat the zone of yarn formation extending between rollers 1 and 2 along the line of their closest adjacency to one another and parallel to their axes of rotation, to lie in an axial direction nearer to that parallel to the axial direction of the yarn being formed thereat which also is the yarn withdrawal direction from the zone. Thus, fibers from the sliver of the first type fibers are fed to the duct 41 (FIGS. 2 and 4) such that they travel or are conveyed therethrough substantially adjacent to the wall 47 (FIG. 4) and the fibers from the sliver of the second fiber type are fed such that they travel or are conveyed therethrough substantially adjacent the wall 48. The conveying airstreams exiting through the channel 49 and through the slot 14 are so controlled that the action of the beater and airstreams on the fibers substantially maintains the distribution of fibers in a continuum of fiber types across the feed duct from the wall 47 to the wall 48. Thus, the airstreams flow such that there is a first zone of flow adjacent the wall 47 into which the fibers fed are substantially wholly of the first fiber type; a second zone of flow exists in the intermediate portion of the duct between walls 47 and 48 in which the fibers fed come from both fiber types and are in admixture in the flow and a third zone of flow adjacent the wall 48 into which the fibers fed are substantially wholly of the second fiber type.

As the respective fibers in these flows are turned by the interacting airstreams, as fully described in aforesaid U.S. Pat. No. 4,315,398, at a location adjacent the throat to be oriented to lie nearer in an axial direction nearer to that which is parallel to the axis of the yarn being formed there, the fibers approach both the throat and the yarn strand therealong in the zone of strand formation such that the length along which one particular fiber is deposited overlaps somewhat with that of another. In other words, the envelope of deposition of the fibers in the throat on the strand being formed there is defined by the airstreams depositing the fibers there to be a substantial continuum of types of fibers from one fiber type to the aforesaid admixtures of types and then to the other fiber type, with each fiber overlapping with many others. This occurs with all the fibers but has particular integrating effect in the intermediate region between what would ordinarily be considered to be the two different components, the sheath and core.

In this way each fiber is tied into the yarn structure by many others through those parts of those fibers fed on either side of it and extending adjacent thereto in a somewhat overlapping orientation. Most of the fibers deposited at the open-end of the strand being formed (near the mouth exit of the duct adjacent to wall 52), coming predominantly or even exclusively from the first fiber type, therefore form mainly the inner part or core portion of the present integral composite strand, and most of the fibers deposited nearest the yarn withdrawal point, (adjacent to the mouth exit of the duct near to wall 51) come from are of the second fiber type and, therefore form mainly the outer part or sheath portion or component of the strand present. However, due to the special spacial fiber distribution and orientation provided by the present invention, many fibers of the second type of fibers have parts of their length inside parts of fibers from the first component and therefore are somewhat wrapped about by those parts, and vice versa.

Therefore, because of, the orientation of the fibers by means of the aforesaid airstream flows, and the manner in which the two types of fibers are fed in a continuum, from the core forming type fibers at one end, that of the open-end of the yarn being formed, through the admixtures of core forming type fibers with sheath forming type fibers in the intermediate region between the ends of the throat yarn formation zone, thence to the sheath forming type fibers alone at the yarn delivery end of the throat, along the full length of the throat as well as the full width of the duct, with a portion of the outer fibers wrapped by a portion of the core forming type fibers, one does not form the simple core sheath yarn structure of the prior art, but rather a yarn structure in which the overlapping fibers in the aforesaid intermediate region of the yarn when viewed in section tie the core and the sheath into an integrated unitary or common structure with the fibers from one predetermined fiber type lying mainly to the outside periphery of the strand.

This unique yarn structure can be used to unusual advantage in several ways. For example blends of cotton and polyester types of fibers can be used according to the invention to provide various yarns where different properties as desired of dye up-take and handle can be obtained by placing one or other of the types of fibers mainly on the outside as the sheath, whilst maintaining integrated properties of strength and heat-shrinkage. Additional ways for example, are to form yarn with low pilling polyester fibers as the sheath component which could be used to great advantage on the outside of conventional and less expensive polyester fibers as the core component of an integrated yarn of this invention, and in similar manner fire-resistant fibers as the sheath component could be used on the outside of less expensive fibers as the core component providing the bulk of the integrated yarn formed by the present process.

We claim:

1. In a process for spinning a yarn from different types of fibers, by separating the fibers into discrete fibers, feeding them for conveyance to an elongate zone of yarn formation, moving the fibers to said zone and depositing them therat, twisting the fibers to form said yarn, and withdrawing said yarn from said zone, the improvement comprising a. orienting said discrete fibers during said separating, feeding, moving, and depositing concurrently and continuously to provide a continuum of said fiber types, from one fiber type to overlapping admixtures of the two fiber types and to the other fiber type, and b. concurrently and continuously depositing and twisting said fibers at said zone of yarn formation as said continuum extending from one end of said zone to the other end of said zone whereat said twisted yarn is withdrawn.

2. The improvement as in claim 1, wherein said orienting includes orienting said fibers axially to a direction approaching one parallel to the axis of said yarn being formed.

3. The improvement as in claim 1, wherein said moving said fibers as said continuum occurs in part through a single, common duct.

4. The improvement as in claim 1, wherein said separating said fibers into discrete fibers and said orienting of said continuum of fiber types is pursued in a single common fiber separator.

5. The improvement as in claim 4, wherein said separating and orienting in said common fiber separator is pursued by feeding stocks of said two types of fibers into said separator in a side-by-side relationship to one another.

6. An elongate yarn article made by the process of claim 1.

7. A method of spinning yarn of two different types of staple fiber comprising concurrently and continuously feeding discrete fibers of said two types along a portion of an elongate yarn formation zone to form a strand thereof with one end open, said feeding being in such a manner that only fibers of one of the two types thereof join the forming yarn strand at the open end thereof and only fibers of the other type of said two types join the forming strand at a position spaced axially from said open end, and further said feeding in such a manner that discrete fibers from both types concurrently land in said yarn formation zone between said open end and said axially spaced away position thereof at all points intermediate thereto, and twisting said fibers thereat to form said yarn, and withdrawing said yarn from said zone of formation, and further wherein at least some fibers of both types overlap as they approach and land at said intermediate points of said yarn formation zone.

8. A method as in claim 7, wherein said feeding is pursued through a single feed duct from a common fiber separator.

* * * * *